US010856616B2

(12) United States Patent
Gooch et al.

(10) Patent No.: US 10,856,616 B2
(45) Date of Patent: Dec. 8, 2020

(54) DYNAMIC INSOLES

(71) Applicant: Superfeet Worldwide, Inc., Ferndale, WA (US)

(72) Inventors: Matthew Gooch, Ferndale, WA (US); Ryan Anderson, Ferndale, WA (US); Eric Hayes, Ferndale, WA (US); Daniel Wakeland, Bellingham, WA (US)

(73) Assignee: SUPERFEET WORLDWIDE, INC., Ferndale, WA (US)

( * ) Notice: Subject to any disclaimer, the term of this patent is extended or adjusted under 35 U.S.C. 154(b) by 51 days.

(21) Appl. No.: 16/265,915

(22) Filed: Feb. 1, 2019

(65) Prior Publication Data

US 2020/0245719 A1 Aug. 6, 2020

(51) Int. Cl.

| | |
|---|---|
| ***A43B 17/00*** | (2006.01) |
| ***A43B 17/16*** | (2006.01) |
| ***A43B 7/14*** | (2006.01) |
| ***A43B 17/02*** | (2006.01) |
| ***A43B 17/14*** | (2006.01) |
| ***A43B 13/38*** | (2006.01) |

(52) U.S. Cl.

CPC ..... *A43B 17/16* (2013.01); *A43B 7/144* (2013.01); *A43B 7/148* (2013.01); *A43B 13/38* (2013.01); *A43B 17/023* (2013.01); *A43B 17/14* (2013.01)

(58) Field of Classification Search

CPC ..... A43B 13/38; A43B 13/386; A43B 17/00; A43B 17/16; A43B 7/144; A43B 7/148

USPC ..... 36/43, 44

See application file for complete search history.

(56) References Cited

U.S. PATENT DOCUMENTS

| | | | | |
|---|---|---|---|---|
| 4,718,179 | A | 1/1988 | Brown | |
| 5,068,983 | A * | 12/1991 | Marc | A43B 7/142 36/43 |
| 5,960,566 | A * | 10/1999 | Brown | A43B 7/14 36/140 |
| 6,173,511 | B1 * | 1/2001 | Perrault | A43B 7/141 36/140 |
| 6,301,807 | B1 * | 10/2001 | Gardiner | A61F 5/14 36/155 |
| 6,408,543 | B1 * | 6/2002 | Erickson | A43B 3/26 36/100 |
| 6,453,578 | B1 * | 9/2002 | Yung | A43B 7/142 36/166 |
| 2007/0033834 | A1 * | 2/2007 | Cheskin | A43B 7/1415 36/44 |
| 2009/0031584 | A1 * | 2/2009 | Rasmussen | A43B 17/00 36/88 |

(Continued)

OTHER PUBLICATIONS

Isman R.E. et al., Anthropometric Studies of the Human Foot and Ankle, Bulletin of Prosthetics Research, Spring 1969, pp. 97-129.

(Continued)

*Primary Examiner* — Marie D Bays

(74) *Attorney, Agent, or Firm* — Lowe Graham Jones PLLC

(57) ABSTRACT

Embodiments are directed to an insole for footwear. The insole preferably includes a bottom surface, a peripheral sidewall, and a relief. The bottom surface has a perimeter, and the peripheral sidewall preferably extends upward from the perimeter of the bottom surface. The relief is preferably disposed in the peripheral sidewall.

21 Claims, 9 Drawing Sheets

(56) References Cited

U.S. PATENT DOCUMENTS

| | | | | |
|---|---|---|---|---|
| 2010/0218398 | A1* | 9/2010 | Reinhardt | A43B 17/02 36/44 |
| 2014/0259758 | A1* | 9/2014 | Yeh | A43B 17/02 36/44 |
| 2015/0237959 | A1* | 8/2015 | Wynn | A43B 7/145 36/44 |
| 2016/0021978 | A1* | 1/2016 | Bae | A43B 17/023 36/44 |
| 2016/0219970 | A1 | 8/2016 | Jacob et al. | |
| 2018/0070670 | A1* | 3/2018 | Granger | A43B 17/006 |
| 2018/0140040 | A1 | 5/2018 | Granger et al. | |
| 2018/0192739 | A1* | 7/2018 | Granger | A43B 17/18 |

OTHER PUBLICATIONS

Redmond A.C. et al., Contoured prefabricated foot orthoses demonstrate comparable mechanical properties to contoured, customised foot orthoses: a plantar pressure study, Journal of Foot and Ankle Research, Jun. 16, 2009, pp. 1-10. http://www.jfootankleres.com/content/2/1/20.

Stefanyshyn D.J. et al., Contribution of the lower extremity joints to mechanical energy in running vertical jumps and running long jumps, Journal of Sports Sciences, 1998, vol. 16, pp. 177-186. https://www.researchgate.net/publication/51323438.

Murley G.S., et al., Do foot orthoses change lower limb muscle activity in flat-arched feet towards a pattern observed in normal-arched feet?, Clinical Biomechanics, Aug. 2010, vol. 25, Issue 7, pp. 728-736. https://www.clinbiomech.com/article/S0268-0033(10)00127-0/fulltext.

Hertel, J. et al., Effect of Foot Orthotics on Quadriceps and Gluteus Medius Electromyographic Activity During Selected Exercises, Archives of Physical Medicine and Rehabilitation, Jan. 2005, vol. 86, pp. 26-30. https://www.archives-pmr.org/article/S0003-9993%2804%2900432-0/abstract.

Nigg, B.M. et al., Effect of shoe insert construction on foot and leg movement, Medicine & Science in Sports & Exercise, May 1998, vol. 30, pp. 550-555. https://www.researchgate.net/publication/13714405.

Nigg, B.M. et al., Effect of Shoe Inserts on Kinematics, Center of Pressure, and Leg Joint Moments during Running, Medicine & Science in Sports & Exercise, Feb. 2003, vol. 35, No. 2, pp. 314-319.

Welsh, B.J. et al., A case-series study to explore the efficacy of foot orthoses in treating first metatarsophalangeal joint pain, Journal of Foot and Ankle Research, Aug. 2010, vol. 3, No. 17. https://jfootankleres.biomedcentral.com/articles/10.1186/1757-1146-3-17.

Mŭundermann, A. et al., Foot orthotics affect lower extremity kinematics and kinetics during running, Clinical Biomechanics, Mar. 2003, vol. 18, Issue 3, pp. 254-262. https://www.clinbiomech.com/article/S0268-0033(02)00186-9/abstract.

Nigg, B.M. et al., Impact Forces and Muscle Tuning: A New Paradigm, Exercise and Sport Sciences Reviews, 2001, vol. 29, No. 1, pp. 37-41. https://www.researchgate.net/publication/12121789.

Manter, J.T., Movements of the Subtalar and Transverse Tarsal Joints, The Anatomical Record, Aug. 1941, vol. 80, No. 4, pp. 397-410.

Nigg, B.M. et al., Muscle tuning and preferred movement path—a paradigm shift, Current Issues in Sport Science (CISS), 2017, vol. 2, No. 7, pp. 1-12. https://www.researchgate.net/publication/321393969.

Mŭndermann, A. et al., Orthotic Comfort Is Related to Kinematics, Kinetics, and EMG in Recreational Runners, Medicine & Science in Sports & Exercise, Oct. 2003, vol. 35, No. 10, pp. 1710-1719. https://www.altmetric.com/details/1173130.

Nurse, M.A. et al., Quantifying a relationship between tactile and vibration sensitivity of the human foot with plantar pressure distributions during gait, Clinical Biomechanics Dec. 1999, vol. 14, Issue 9, pp. 667-672. https://www.researchgate.net/publication/12778203.

Mŭndermann, A. et al., Relationship between comfort of shoe inserts and anthropometric and sensory factors, Medicine & Science in Sports & Exercise, Dec. 2001, vol. 33, No. 11, pp. 1939-1945. https://www.researchgate.net/publication/10658602.

Nigg, B.M. et al., Running shoes and running injuries: Mythbusting and a proposal for two new paradigms: 'Preferred movement path' and 'comfort filter', British Journal of Sports Medicine, Jul. 2015, 10.1136/bjsports-2015-095054. https://www.researchgate.net/publication/280568179.

Nigg, B.M. et al., Shoe inserts and orthotics for sport and physical activity, Medicine & Science in Sports & Exercise, Jul. 1999, vol. 31, No. 7(Suppl.) pp. S421-S428. https://www.correctiezolen.nl/nl_NL/file/document/page/73/.

Nurse, M.A. et al. The effect of changes in foot sensation on plantar pressure and muscle activity, Clinical Biomechanics, Dec. 2001, vol. 16, Issue 9, pp. 719-727. https://www.researchgate.net/publication/11639914.

Close, J.R. et al., The Function of the Subtalar Joint, Clinical Orthopedics and Related Research, Jan.-Feb. 1967, No. 50, pp. 159-179.

Wen Liu, D.J. et al., The Relationship of Foot Shape and Sensitivity to Comfort of Shoe-Inserts, Department of National Defence, Jul. 30, 1998, PWGSC Contract No. W7711-7-7369/001SRV.

International Search Report and Written Opinion dated Jun. 9, 2020 for corresponding PCT Application No. PCT/US2020/015938; 16 pages.

* cited by examiner

DYNAMIC INSOLES

FIELD OF THE INVENTION

This application relates to insoles and, more particularly, yet not exclusively, insoles providing variable haptic feedback.

BACKGROUND OF THE INVENTION

Typical insoles of a given model from a given manufacturer have a predetermined stiffness that is the same for each wearer. Some wearers have high haptic sensitivity, such as high sensitivity to insole stiffness, vibration, or other kinesthetic or tactile sensations. For a sensitive wearer, a structured insole can overwhelm the wearer with vibration or stiffness. Sock liners are less structured and provide less haptic feedback to sensitive wearers yet also provide less support than structured insoles. Accordingly, there exists a need for an improved insole that provides support and also mitigates haptic feedback provided to the wearer.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Preferred Embodiment, which is to be read in association with the accompanying drawings, wherein.

SUMMARY OF THE INVENTION

Figure 1:
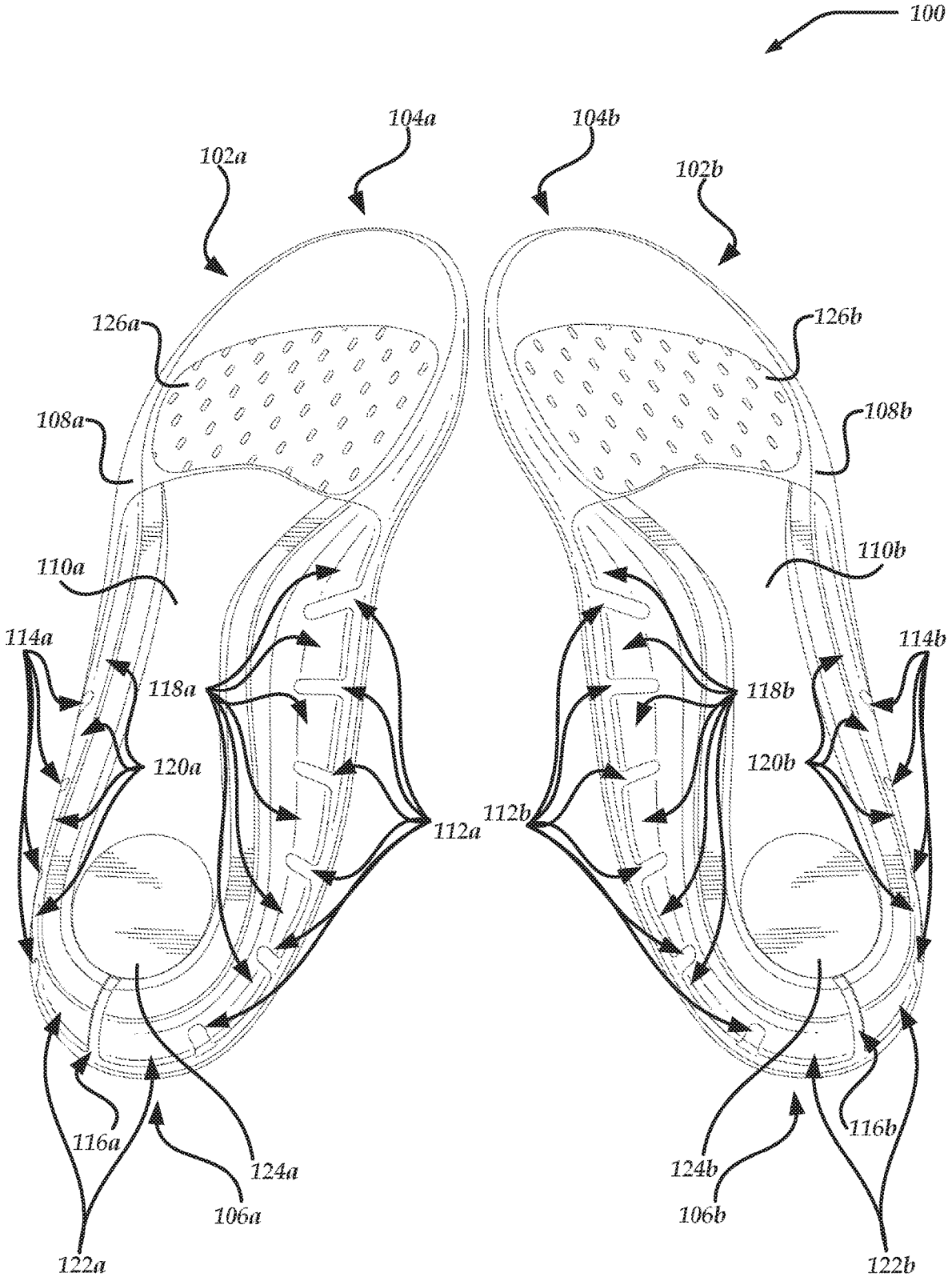
FIG. 1 is a perspective bottom view of a preferred insole pair.

The following briefly describes example embodiments of the invention to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to an insole for footwear. The insole preferably includes a bottom surface, a peripheral sidewall, and a relief. The bottom surface has a perimeter, and the peripheral sidewall preferably extends upward from the perimeter of the bottom surface. Preferably, the relief is disposed in the peripheral sidewall.

Preferably, the insole has a toe-end portion and a heel-end portion. In some version, the insole has a longitudinal axis that extends from the toe-end portion to the heel-end portion. Preferably, the relief has a longitudinal axis that is oriented with an offset angle of 0-45° from the longitudinal axis of the insole.

Preferably, the peripheral sidewall has an outer perimeter. In some versions, the relief has a longitudinal axis that extends toward a point in the outer perimeter of the peripheral sidewall. Preferably, the peripheral sidewall has a tangent at the point in the outer perimeter of the peripheral sidewall. In some versions, the longitudinal axis of the relief is oriented with an offset angle of 80-90° from the tangent at the point in the outer perimeter of the peripheral sidewall. In some versions, the relief extends to the outer perimeter of the peripheral sidewall.

Preferably, the relief extends from the peripheral sidewall into the bottom surface.

Preferably, the bottom surface has a hole that is positioned, sized, and dimensioned to receive a heel pad. In some versions, the relief extends to the hole.

Preferably, the insole includes a second relief. In some versions, the relief and the second relief are disposed on opposite sides of the hole from each other.

Preferably, the bottom surface has a toe-end portion and a heel-end portion disposed rearward of the toe-end portion. In some versions, at least a portion of the relief is disposed rearward of the heel-end portion of the bottom surface.

Preferably, at least one portion of the peripheral sidewall provides an arch support. In some versions, the relief is disposed in the at least one portion of the peripheral sidewall that provides the arch support.

Preferably, the insole includes a second relief in the peripheral sidewall. In some versions, the relief and the second relief define a tab disposed between the relief and the second relief. Preferably, at least a portion of the tab is movable relative to the bottom surface.

Preferably, the bottom surface includes a bottom surface of a heel cap. In some versions, the peripheral sidewall includes a peripheral sidewall of the heel cap.

Preferably, the insole includes an insole pad. In some versions, the bottom surface includes a bottom surface of a heel cap. Preferably, the peripheral sidewall includes a peripheral sidewall of the heel cap. In some versions, the insole pad has a recess that is positioned, sized, and dimensioned to receive at least a portion of the heel cap.

Preferably, the insole includes an insole pad. In some versions, the bottom surface includes a bottom surface of a heel cap. Preferably, the peripheral sidewall includes a peripheral sidewall of the heel cap. In some versions, the insole pad has a plug that at least partially fills the relief.

Preferably, the relief has a radiused end portion. In some versions, the relief includes a relief cut.

Preferably, the insole includes an insole pad and a heel cap that couples to the insole pad. In some versions, the heel cap is more rigid than the insole pad. Preferably, the heel cap includes the bottom surface, the peripheral sidewall, and the relief. In some versions, the insole cap has a relief plug that is positioned, sized, and dimensioned to be received in the relief in the heel cap.

Also, briefly stated, various embodiments are directed to a set of insoles for footwear. Preferably, the set of insoles include a first insole of a first size and a second insole of the first size. The first insole preferably includes a first bottom surface, a first peripheral sidewall, and a first relief. The first bottom surface has a perimeter, and the first peripheral sidewall preferably extends upward from the perimeter of the first bottom surface. Preferably, the first relief is disposed in the first peripheral sidewall. The second insole preferably includes a second bottom surface, a second peripheral sidewall, and a second relief. The second bottom surface has a perimeter, and the second peripheral sidewall preferably extends upward from the perimeter of the second bottom surface. Preferably, the second relief is disposed in the second peripheral sidewall. The second peripheral sidewall is preferably less rigid than the first sidewall. Preferably, the second relief is smaller than the first relief.

Preferably, the first peripheral sidewall includes a first material. In some versions, the second peripheral wall includes a second material that is less stiff than the first material.

Preferably, the first bottom surface has a toe-end portion and a heel-end portion disposed rearward of the toe-end portion of the first bottom surface. In some versions, at least a portion of the first relief is disposed rearward of the heel-end portion of the first bottom surface. Preferably, the second bottom surface has a toe-end portion and a heel-end portion disposed rearward of the toe-end portion of the second bottom surface. In some versions, at least a portion of the second relief is disposed rearward of the heel-end portion of the second bottom surface.

Preferably, at least one portion of the first peripheral sidewall provides a first arch support. In some versions, the first relief is disposed in the at least one portion of the first peripheral sidewall that provides the first arch support. Preferably, at least one portion of the second peripheral sidewall provides a second arch support. In some versions, the second relief is disposed in the at least one portion of the second peripheral sidewall that provides the second arch support.

Preferably, the first relief includes a first relief cut. In some versions, the second relief includes a second relief cut.

Also, briefly stated, various embodiments are directed to an insole for footwear. Preferably, the insole includes an insole pad and a heel cap. The heel cap couples to the insole pad. In some versions, the heel cap has a bottom surface with a perimeter, a peripheral sidewall that extends upward from the perimeter of the bottom surface, and a relief in the peripheral sidewall.

Preferably, the relief is a first relief, and, in some versions, the heel cap has a second relief in the peripheral sidewall. In some versions, the heel cap has a heel-support portion, and the first relief is preferably positioned in the heel-support portion. Preferably, the heel cap has an arch-support portion, and, in some versions, the second relief is positioned in the arch-support portion.

DETAILED DESCRIPTION OF THE PREFERRED EMBODIMENT

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

As used herein, the term "or" refers to a grammatical conjunction to indicate that one or more of the connected terms may be employed. For example, the phrase "one or more A, B, or C" is employed to discretely refer to each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" is not exclusive and allows for being based on additional factors not described, unless the context clearly dictates otherwise. In addition, the meaning of "a," "an," and "the" include plural references. Plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

FIG. 1 is a perspective bottom view of insole pair 100. Insole pair 100 includes right insole 102*a* and left insole 102*b*. Insoles 102*a*, 102*b* have toe-end portions 104*a*, 104*b* and heel-end portions 106*a*, 106*b*. Preferably, insole pads 108*a*, 108*b* extend from heel-end portions 106*a*, 106*b* to toe-end portions 104*a*, 104*b*. Heel caps 110*a*, 110*b* couple to insole pads 108*a*, 108*b*. Caps 110*a*, 110*b* are preferably adhesively applied to insole pads 108*a*, 108*b*. As described in further detail below, insole pads 108*a*, 108*b* are preferably made of elastically flexible material such as closed cell foam whereas heel caps 110*a*, 110*b* are made of more rigid materials such as plastics, fiber-reinforced plastics, or other composites. Thus, the heel caps provide structural support to the foot, especially the heel and arch areas. Heel caps 110*a*, 110*b* preferably have one or more medial reliefs 112*a*, 112*b*, lateral reliefs 114*a*, 114*b*, or heel reliefs 116*a*, 116*b* in one or more peripheral sidewalls of heel caps 110*a*, 110*b*. The reliefs define one or more tabs in the one or more peripheral sidewalls of heel caps 110*a*, 110*b*. Preferably, the tabs are movable relative to a bottom surface of the heel caps in ordinary use, such as when a wearer walks. One or more of the reliefs or tabs, such as heel reliefs 116*a*, 116*b*, may extend from the peripheral sidewalls of heel caps 110*a*, 110*b* to the bottom surface of heel caps 110*a*, 110*b*. One or more of the reliefs or tabs, such as medial reliefs 112*a*, 112*b* or lateral reliefs 114*a*, 114*b* may be disposed only in the peripheral sidewalls of heel caps 110*a*, 110*b* and my not extend to or into the bottom surface of heel caps 110*a*.

As shown in FIG. 1, medial reliefs 112*a*, 112*b* define one or more medial tabs 118*a*, 118*b* (portions of the peripheral sidewalls of heel caps 110*a*, 110*b* disposed between medial reliefs 112*a*, 112*b* or between the forward-most medial reliefs and the front perimeters of heel caps 110*a*, 110*b*), lateral reliefs 114*a*, 114*b* define one or more lateral tabs 120*a*, 120*b* (portions of the peripheral sidewalls of heel caps 110*a*, 110*b* disposed between lateral reliefs 114*a*, 114*b* or between the forward-most lateral reliefs and the front perimeters of heel caps 110*a*, 110*b*), and heel reliefs 116*a*, 116*b* define heel tabs 122*a*, 122*b* (portions of the peripheral sidewalls of heel caps 110*a*, 110*b* disposed between the rearward-most medial or lateral reliefs, between two or more heel reliefs, or between the rearward-most medial or lateral reliefs and heel reliefs 116*a*, 116*b*). The reliefs facilitate the tabs moving relative to each other or the bottom surfaces of heel caps 110*a*, 110*b* with greater freedom than if the reliefs were absent and the tabs were connected to each other as a single unitary structure. Accordingly, insoles 102*a*, 102*b* provide greater support than a sock liner while facilitating or providing greater damping (reduced vibration) and reduced haptic feedback than insoles lacking reliefs, thereby increasing comfort experienced by the wearer. The same effect may be achieved with the alternate embodiment wherein the reliefs are provided with a thinner material or with a differing, softer material than the remaining sidewall material as explained below.

Preferably, heel caps 110*a*, 110*b* have heel pads 124*a*, 124*b* disposed in the heel-end portions of heel caps 110*a*, 110*b*. Insole pads 108*a*, 108*b* preferably have forefoot pads 126*a*, 126*b* disposed in the regions of insole pads 108*a*, 108*b* that correspond to the balls of the feet of the wearer. As shown in FIG. 1, each of reliefs 112*a*, 112*b*, 114*a*, 114*b*, 116*a*, and 116*b* extend to and are open at the perimeters of heel caps 110*a*, 110*b*, and heel reliefs 116*a*, 116*b* extend to and are open at the perimeters of heel pads 124*a*, 124*b*. As also shown in FIG. 1, each of the reliefs are relief cuts. Alternatively or additionally, one or more of the reliefs may include a different material, structure (for example, a mesh or honeycomb structure), or thickness (for example, 50% of the thickness of adjacent portions of heel caps 110*a*, 110*b*) than the remainder of heel caps 110*a*, 110*b* to facilitate the one or more reliefs being more flexible or having a higher degree of damping than the remainder of heel caps 110*a*, 110*b*. In some versions, one or more of the tabs 118*a*, 118*b*, 120*a*, 120*b*, 122*a*, and 122*b* may include a different material than the remainder of heel caps 110*a*, 110*b*, such as a more flexible material or a material that provides a higher degree of damping.

Figure 2:
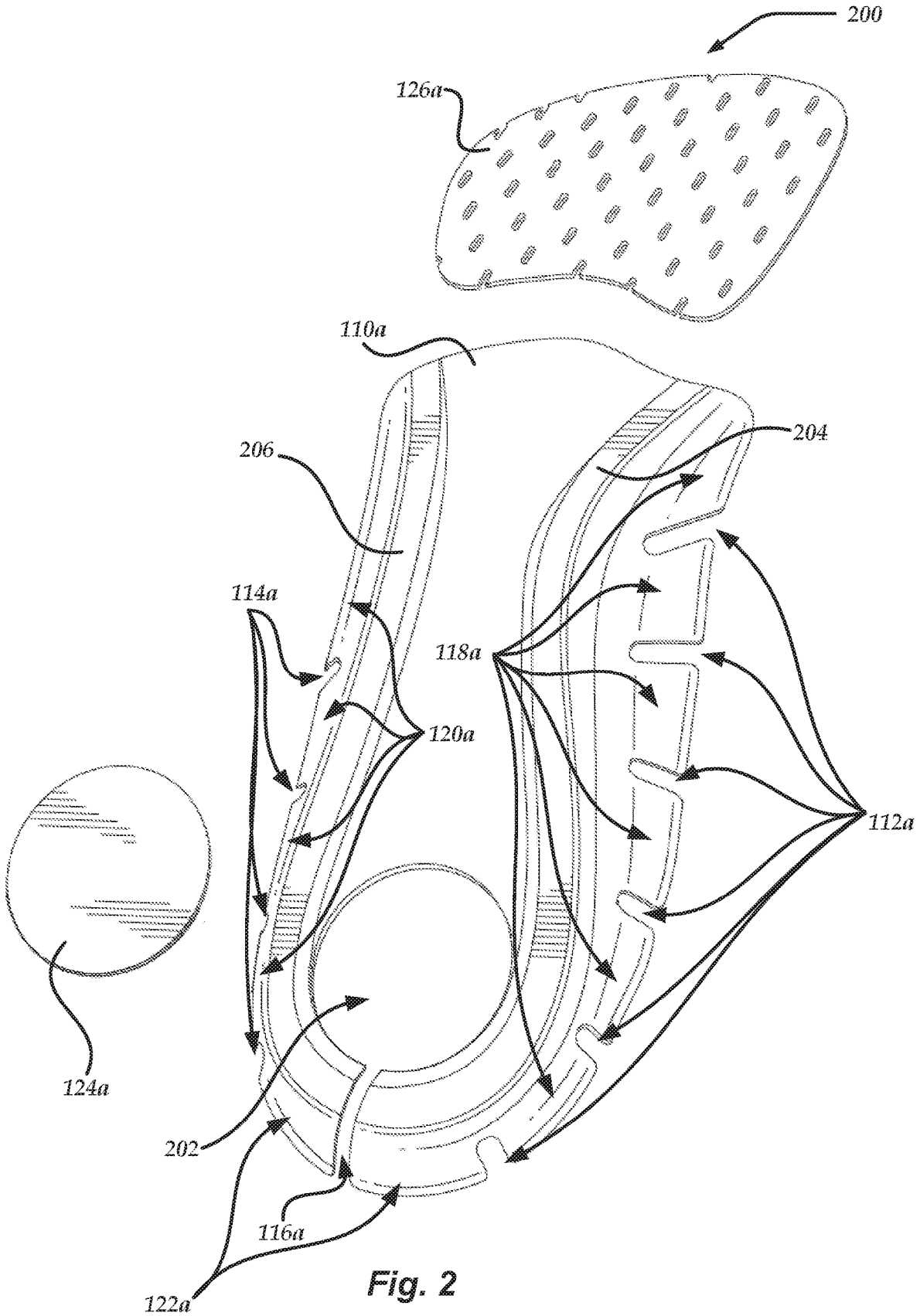
FIG. 2 is an exploded perspective bottom view of portions of an insole in the insole pair of FIG. 1.

FIG. 2 is an exploded perspective bottom view of portions 200 of insole 102*a*, including heel cap 110*a*, heel pad 124*a*, and forefoot pad 126*a*. As shown in FIG. 2, heel cap 110*a* has hole 202 that is sized and dimensioned to receive heel pad 124*a*. Preferably, hole 202 has a depth that facilitates receiving heel pad 124*a* with a bottom surface of heel pad 124*a* extending slightly past or being flush with the bottom surface of heel cap 110*a*. In FIG. 2, hole 202 extends entirely through heel cap 110*a*. In other versions, hole 202 extends only partially through heel cap 110*a*. Preferably, heel cap 110*a* has one or more ridges, such as ridges 204, 206, that extend at least partially around the perimeter of the bottom surface of heel cap 110*a* (the portion of heel cap 110*a* that is surrounded or at least partially surrounded by the peripheral sidewalls of heel cap 110*a* or that is parallel to or nearly parallel to the floor when worn by a stationary standing wearer with both feet flat on the floor), with the one or more peripheral sidewalls of heel cap 110*a* being defined as the portions of heel cap 110*a* that are disposed outward from the perimeter of the bottom surface of heel cap 110*a* (for example, outward of ridges 204, 206). Heel cap 110*a*, heel pad 124*a*, and forefoot pad 126*a* preferably have structures that are mirror copies of those of insole 102*a*, yet some wearers may prefer different structures for left and right insoles.

Figure 3:
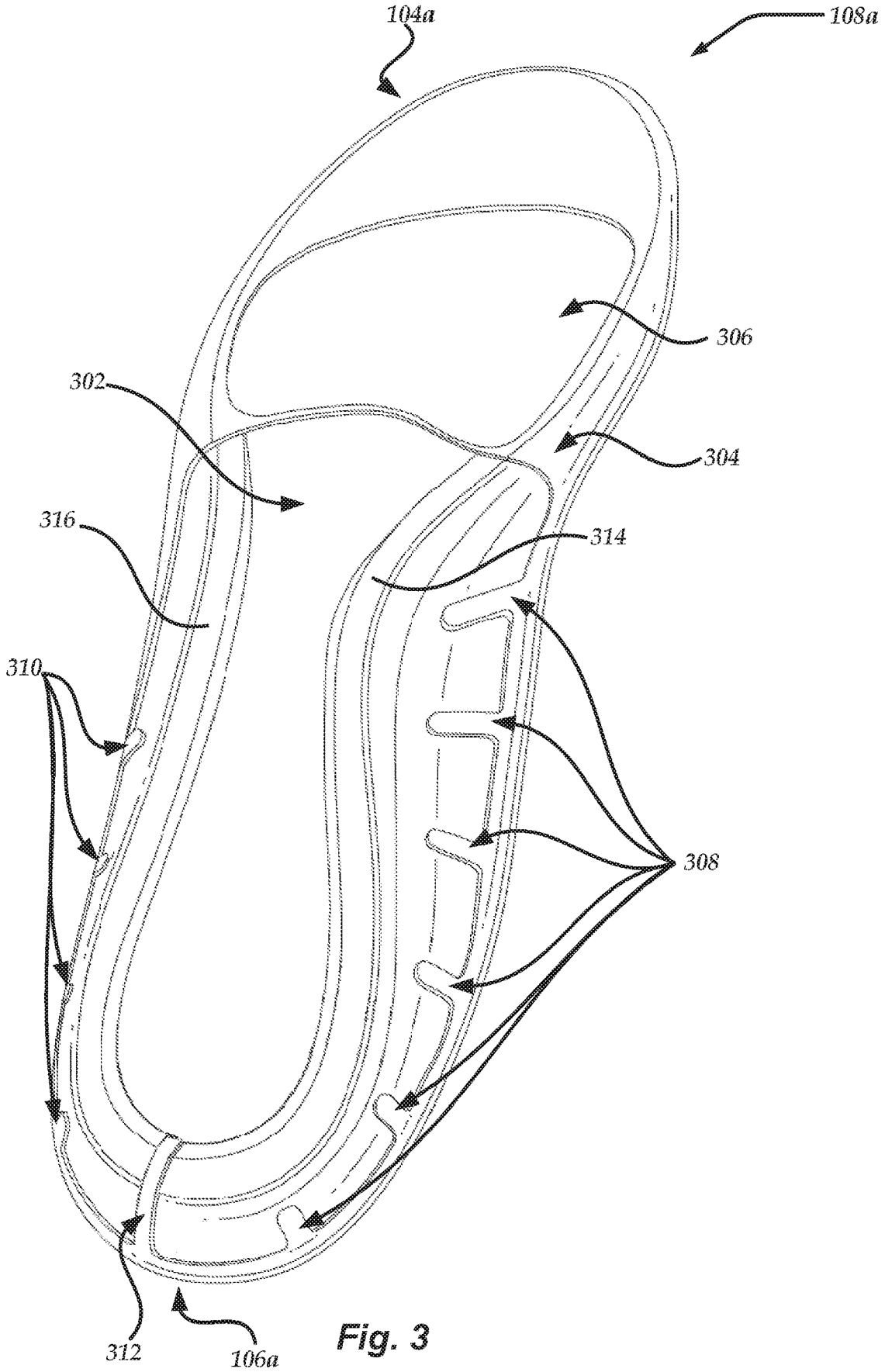
FIG. 3 is a bottom perspective view of a portion of an insole in the insole pair of FIG. 1.

FIG. 3 is a bottom perspective view of insole pad 108*a* of insole 102*a*. Insole pad 108*a* preferably has recessed region 302 that is sized and dimensioned to receive heel cap 110*a*. Preferably, recessed region 302 has a depth relative to non-recessed surface 304 that facilitates receiving heel cap 110*a* with the bottom surface of heel cap 110*a* or the outer surfaces of the peripheral sidewalls of heel cap 110*a* being flush with non-recessed surface 304 of insole pad 108*a* (see FIG. 1). As shown in FIG. 3, non-recessed surface 304 includes portions of the bottom surface and the peripheral sidewalls of insole pad 104*a*. Insole pad 108*a* preferably has recessed region 306 that is sized and dimensioned to receive forefoot pad 126*a*. Preferably, recessed region 306 has a depth relative to non-recessed surface 304 that facilitates receiving forefoot pad 126*a* with a bottom surface of forefoot pad 126*a* being flush with non-recessed surface 304 of insole pad 108*a* (see FIG. 1). In some versions, the depth of a recessed region of insole pad 108*a* is defined as a thickness of insole pad 108*a* at a position along a perimeter of non-recessed surface 304 adjacent to the recessed region minus a thickness of insole pad 108*a* at a position along a perimeter of the recessed region adjacent to the position along the perimeter of non-recessed surface 304.

Preferably, insole pad 108*a* has one or more relief plugs that are positioned, sized, and dimensioned to be received by one or more reliefs in heel cap 110*a*. The one or more relief plugs may partially or entirely fill the one or more reliefs when heel cap 110*a* is coupled to insole pad 108*a*. As shown in FIG. 3, insole pad 108*a* has one or more medial relief plugs 308, lateral relief plugs 310, or heel relief plugs 312. Insole pad 108*a* preferably has one or more ridges, such as ridges 314, 316, that extend at least partially around the perimeter of the bottom surface of recessed region 302 (the portion of recessed region 302 that is surrounded or at least partially surrounded by the peripheral sidewalls of insole pad 104*a* or that is parallel to or nearly parallel to the floor when worn by a stationary standing wearer with both feet flat on the floor), with one or more peripheral sidewalls of insole pad 108*a* being defined as the portions of insole pad 108*a* that are disposed outward from the perimeter of the bottom surface of recessed region 302 (for example, outward of ridges 314, 316). Preferably, the ridges 314, 316 are positioned, sized, and dimensioned to be received by ridges 204, 206 of heel cap 110*a*. Insole pad 108*b* preferably has a structure that is a mirror copy of that of insole 102*a*, yet some wearers may prefer different structures for left and right insoles.

Figure 4:
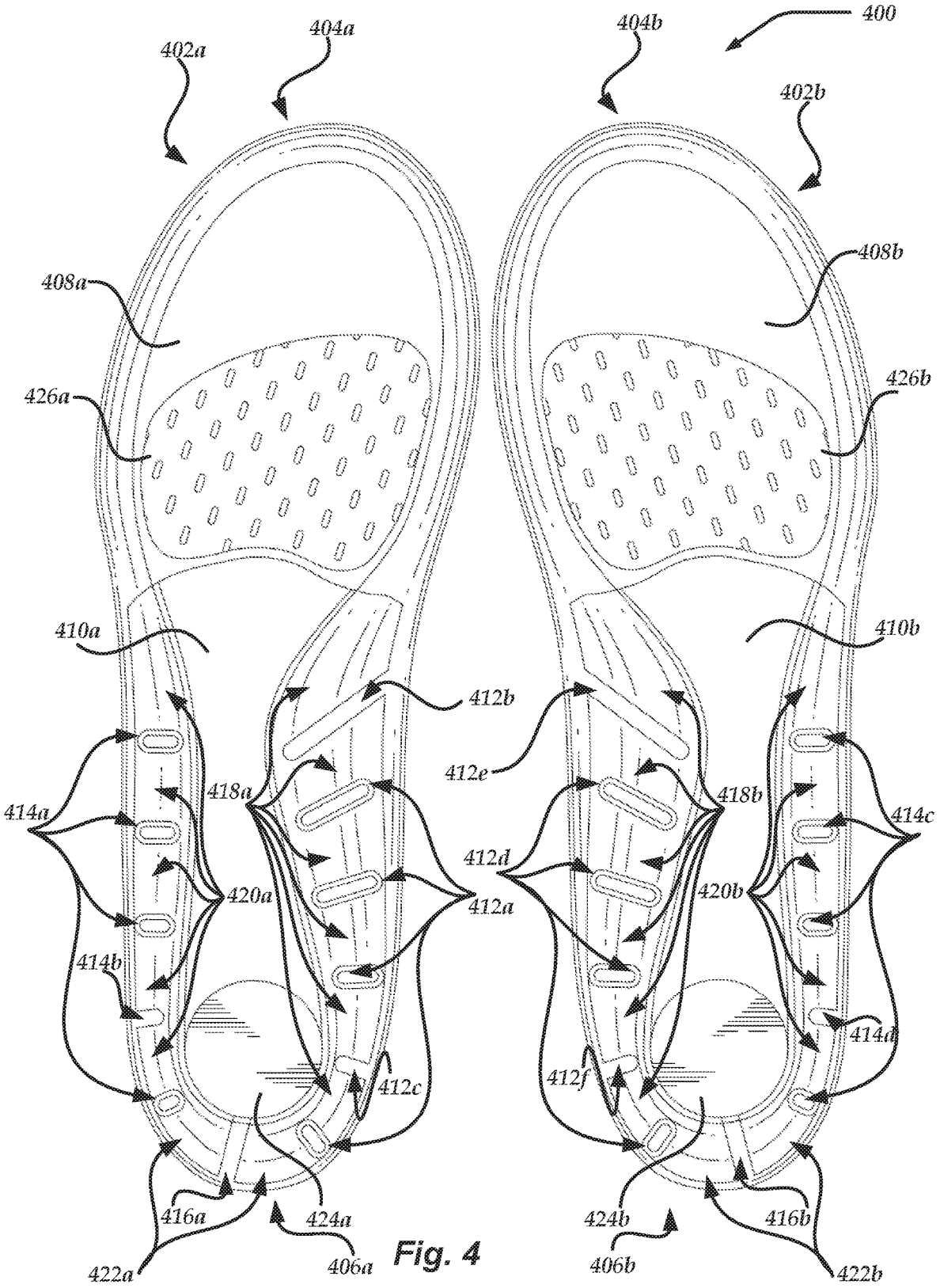
FIG. 4 is a bottom view of a preferred insole pair.

FIG. 4 is a bottom view of a most preferred insole pair 400. Insole pair 400 includes right insole 402*a* and left insole 402*b*. Insoles 402*a*, 402*b* have toe-end portions 404*a*, 404*b* and heel-end portions 406*a*, 406*b*. Preferably, insole pads 408*a*, 408*b* extend from heel-end portions 406*a*, 406*b* to toe-end portions 404*a*, 404*b*. Heel caps 410*a*, 410*b* couple to insole pads 408*a*, 408*b*. Heel caps 410*a*, 410*b* preferably have one or more medial reliefs 412*a*-412*f*, lateral reliefs 414*a*-414*d*, or heel reliefs 416*a*, 416*b* in one or more peripheral sidewalls of heel caps 410*a*, 410*b*. The reliefs define one or more tabs in the one or more peripheral sidewalls of heel caps 410*a*, 410*b*.

As shown in FIG. 4, medial reliefs 412*a*-412*f* define one or more medial tabs 418*a*, 418*b* (portions of the peripheral sidewalls of heel caps 410*a*, 410*b* disposed between medial reliefs 412*a*-412*f* or between the forward-most medial reliefs and the front perimeters of heel caps 410*a*, 410*b*), lateral reliefs 414*a*-414*d* define one or more lateral tabs 420*a*, 420*b* (portions of the peripheral sidewalls of heel caps 410*a*, 410*b* disposed between lateral reliefs 414*a*-414*d* or between the forward-most lateral reliefs and the front perimeters of heel caps 410*a*, 410*b*), and heel reliefs 416*a*, 416*b* define heel tabs 422*a*, 422*b* (portions of the peripheral sidewalls of heel caps 410*a*, 410*b* disposed between the rearward-most medial or lateral reliefs, between two or more heel reliefs, or between the rearward-most medial or lateral reliefs and heel reliefs 416*a*, 416*b*). The reliefs facilitate the tabs moving relative to each other or the bottom surfaces of heel caps 410*a*, 410*b* with greater freedom than if the reliefs were absent and the tabs were connected to each other as a single unitary structure. Accordingly, insoles 402*a*, 402*b* provide greater support than a sock liner while facilitating providing greater damping (reduced vibration) and reduced haptic feedback than insoles lacking reliefs, thereby increasing comfort experienced by the wearer.

Preferably, heel caps 410*a*, 410*b* have heel pads 424*a*, 424*b* disposed in the heel-end portions of heel caps 410*a*, 410*b*. Insole pads 408*a*, 408*b* preferably have forefoot pads 426*a*, 426*b* disposed in the regions of insole pads 408*a*, 408*b* that correspond to the balls of the feet of the wearer. As shown in FIG. 4, each of reliefs 412*b*, 412*c*, 412*e*, 412*f*, 414*b*, 414*d*, 416*a*, 416*b* extend to and are open at the perimeters of heel caps 410*a*, 410*b*, and heel reliefs 416*a*, 416*b* extend to and are open at the perimeters of heel pads 424*a*, 424*b*. As also shown in FIG. 4, each of reliefs 412*b*, 412*c*, 412*e*, 412*f*, 414*b*, 414*d*, 416*a*, 416*b* are relief cuts. Reliefs 412*a*, 412*d*, 414*a*, 414*c* are spaced apart from the perimeters of heel caps 410*a*, 410*b*. Reliefs 412*a*, 412*d*, 414*a*, 414*c* preferably include a different material, structure (for example, a mesh or honeycomb structure), or thickness than the remainder of heel caps 410*a*, 410*b* to facilitate the one or more of reliefs 412*a*, 412*d*, 414*a*, 414*c* being more flexible or having a higher degree of damping than the remainder of heel caps 410*a*, 410*b*. Alternatively or additionally, one or more of reliefs 412*a*, 412*d*, 414*a*, 414*c* may be relief cuts that are spaced apart from the perimeters of heel caps 410*a*, 410*b*. In some versions, one or more of the tabs 118*a*, 118*b*, 120*a*, 120*b*, 122*a*, and 122*b* (the portions between the reliefs) may include a different material than the remainder of heel caps 410*a*, 410*b*, such as a more flexible material or a material that provides a higher degree of damping.

Preferably, insoles 402*a*, 402*b* have structures and features as described regarding insoles 102*a*, 102*b* in relationship to FIGS. 2 and 3. For example, insoles 402*a*, 402*b* preferably have one or more depths, ridges, relief plugs, or other structures or features as described regarding FIGS. 2 and 3. As another example, insole pads 408*a* preferably have one or more relief plugs (not shown) that are spaced apart from the non-recessed surface of insole pads 408*a*, 408*b* and extend downward or outward into one or more of reliefs 412*a*, 412*d*, 414*a*, 414*c*.

Figure 5:
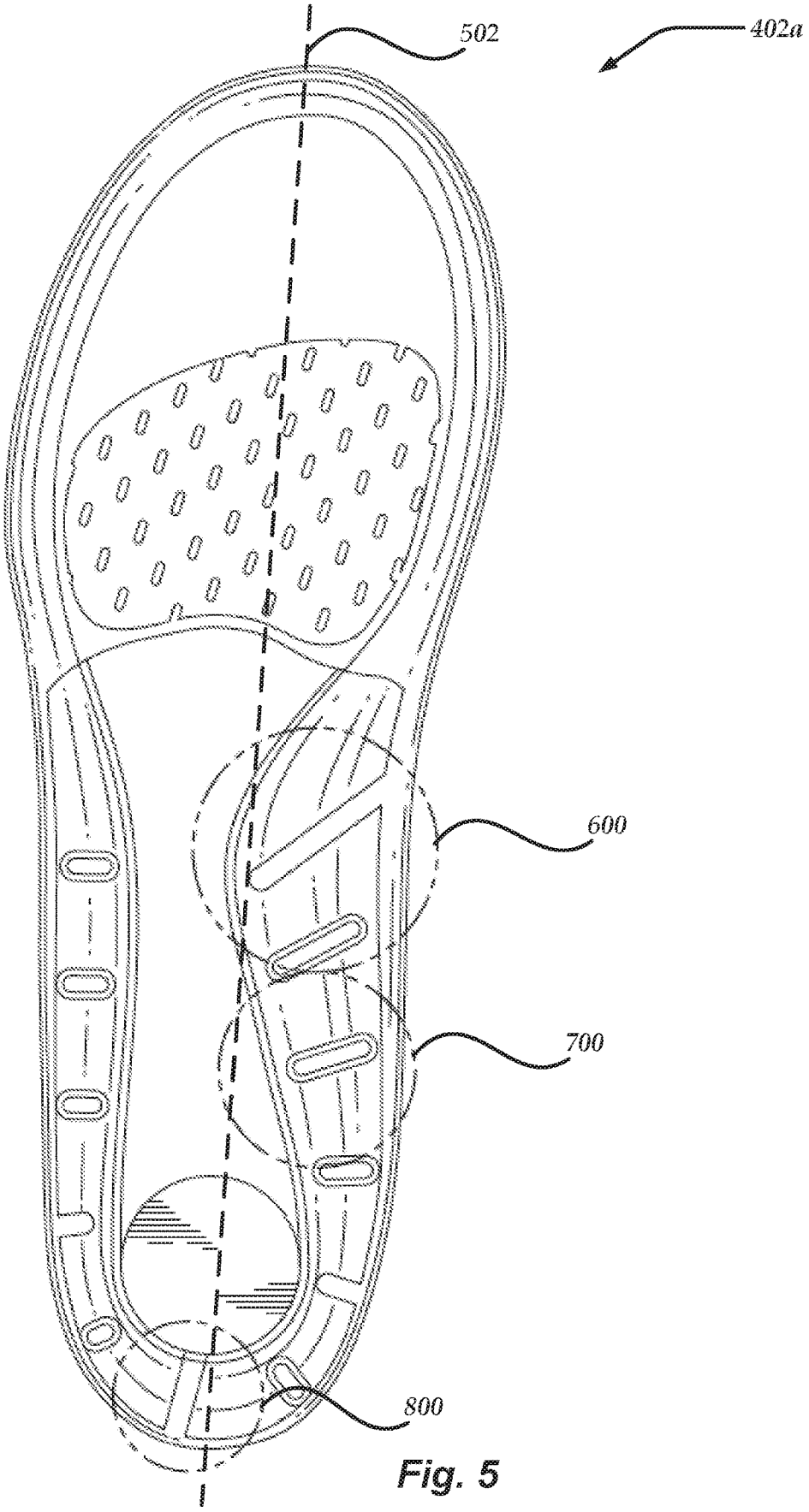
FIG. 5 is a bottom view of an insole of the insole pair of FIG. 4.

FIG. 5 is a bottom view of insole 402*a*. Each insole pad has a longitudinal axis, such as longitudinal axis 502, that extends from a rearward-most portion of the insole pad to the forward-most portion of the insole. Insole pad 108*b* and heel cap 410*b* preferably have structures that are mirror copies of those of insole 402*a*, yet some wearers may prefer different structures for left and right insoles.

Figure 6:
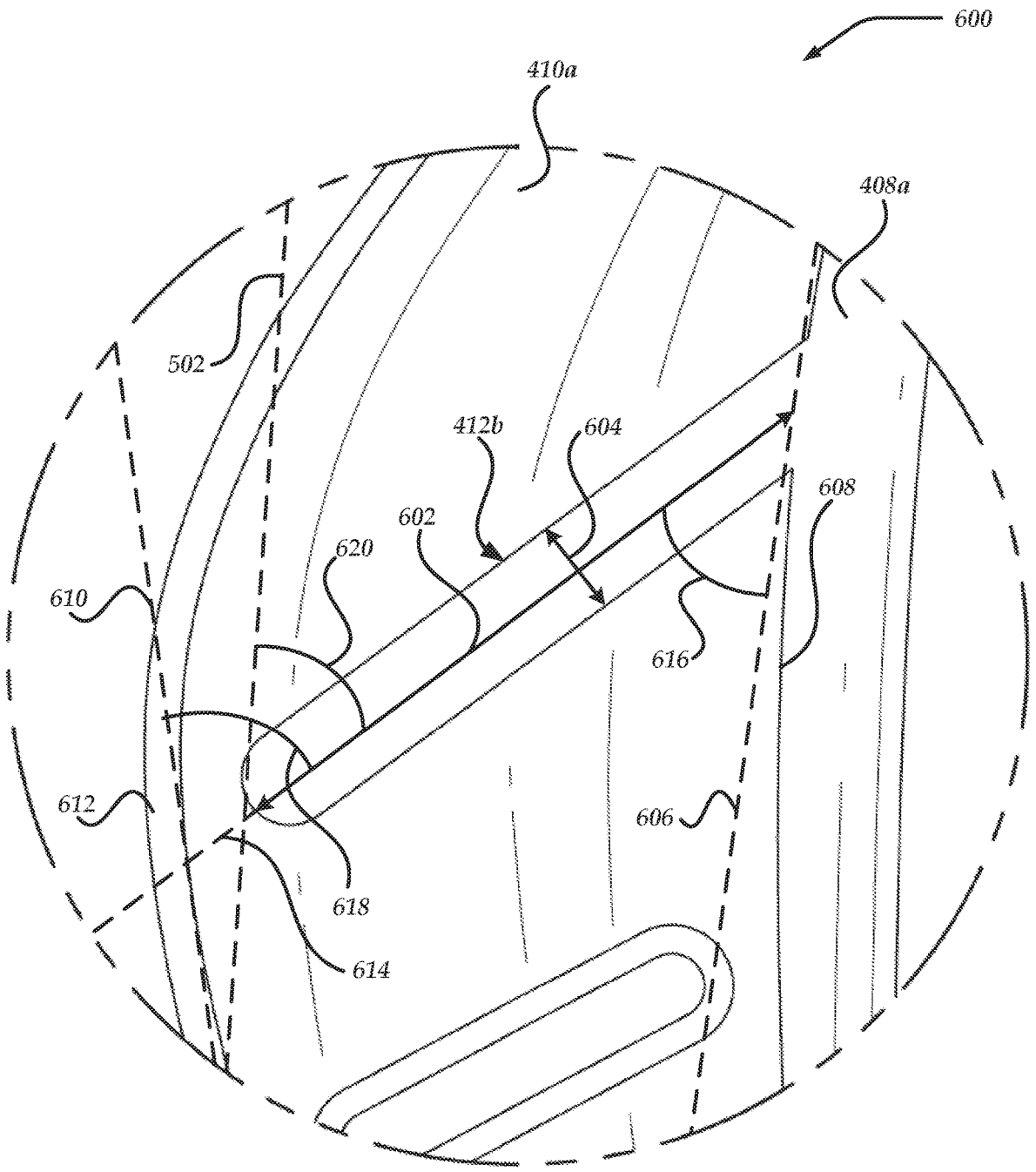
FIG. 6 is a bottom view of a portion of the insole of FIG. 5.

FIG. 6 is a bottom view of the portion of insole 402*a* in circle 600 of FIG. 5. Medial relief 412*b* has longitudinal axis 602 and lateral axis 604 that is perpendicular to longitudinal axis 602 at each position along longitudinal axis 602. The length of medial relief 412*b* is measured along longitudinal axis 602, and the width of medial relief 412*b* is measured along lateral axis 604. As shown in FIGS. 1-8, the reliefs are straight and have widths that are constant or mostly constant (constant width in the portions other than the radiused end portions) along their lengths. In other versions, one or more reliefs may have one or more of curves along their lengths or widths that vary along their lengths.

FIG. 6 shows tangent line 606 that is tangent to perimeter 608 of heel cap 410*a* at the corresponding end-point of longitudinal axis 602 and tangent line 610 that is tangent to the outer edge of ridge 612 at the corresponding point through which extension 614 of longitudinal axis 602 extends. As shown in FIG. 6, longitudinal axis 602 of relief 412*b* is oriented with offset angle 616 relative to tangent line 606, offset angle 618 relative to tangent line 610, and offset angle 620 relative to longitudinal axis 502 of insole pad 408*a*.

Figure 7:
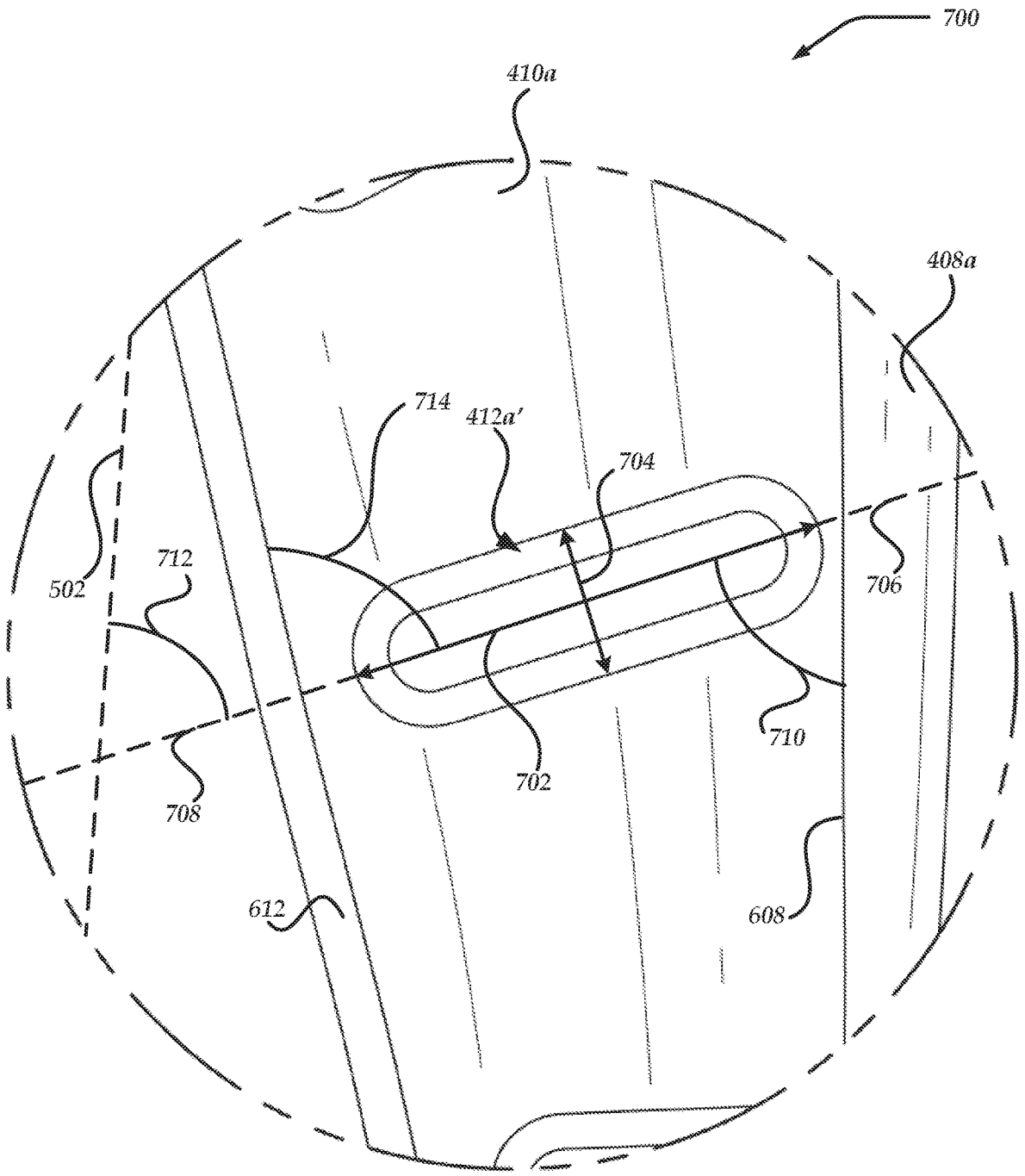
FIG. 7 is a bottom view of a portion of the insole of FIG. 5.

FIG. 7 is an isometric bottom view of the portion of insole 402*a* in circle 700 of FIG. 5. Medial relief 412*a*' has longitudinal axis 702 and lateral axis 704 that is perpendicular to longitudinal axis 702 at each position along longitudinal axis 702. The length of medial relief 412*a*' is measured along longitudinal axis 702, and the width of medial relief 412*a*' is measured along lateral axis 704.

FIG. 7 shows that the tangent of perimeter 608 of heel cap 410*a* at the intersection between extension 706 of longitudinal axis 702 and perimeter 608 of heel cap 410*a* coextends with perimeter 608 at that intersection. The tangent of the outer edge of ridge 612 at the intersection between extension 708 of longitudinal axis 702 and the outer edge of ridge 612 coextends with the outer edge of ridge 612 at that intersection. As shown in FIG. 7, longitudinal axis 702 of relief 412*a*' is oriented with offset angle 710 relative to perimeter 608 of heel cap 410*a* where perimeter 608 intersects extension 706, offset angle 712 relative to the outer edge of ridge 612 where the outer edge of ridge 612 intersects extension 708, and offset angle 714 relative to longitudinal axis 502 of insole pad 408*a*.

Figure 8:
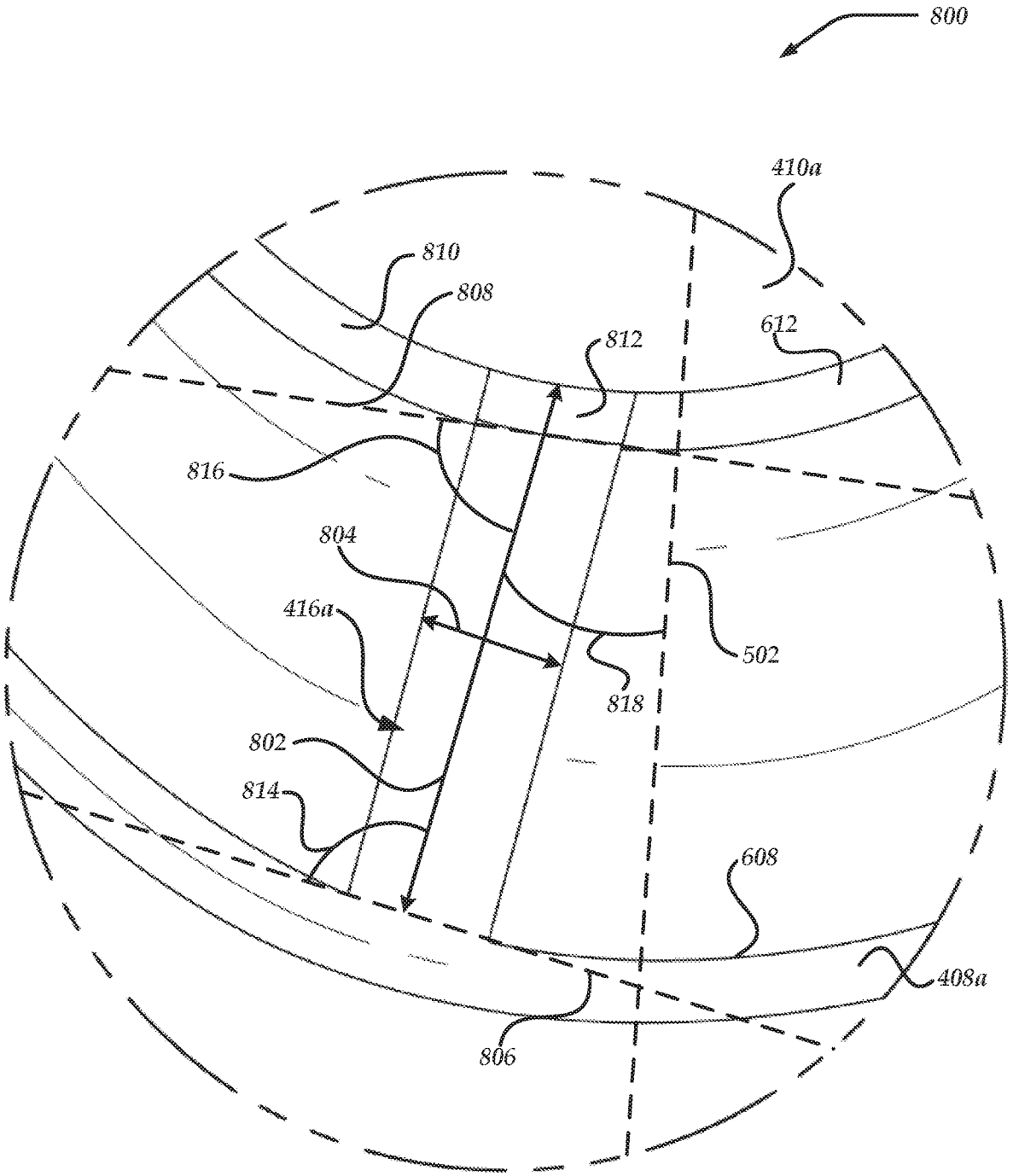
FIG. 8 is a bottom view of a portion of the insole of FIG. 5.

FIG. 8 is a bottom view of the portion of insole 402*a* in circle 800 of FIG. 5. Heel relief 416*a* has longitudinal axis 802 and lateral axis 804 that is perpendicular to longitudinal axis 802 at each position along longitudinal axis 802. The length of heel relief 416*a* is measured along longitudinal axis 802, and the width of heel relief 416*a* is measured along lateral axis 804.

FIG. 8 shows tangent line 806 that is tangent to perimeter 608 of heel cap 410*a* at the corresponding end-point of longitudinal axis 802 and tangent line 808 that is tangent to the outer edge of ridge 612, to the outer edge of ridge 810, or to the outer edge of ridge 812 of insole pad 408*a* at the corresponding end-point of longitudinal axis 802. As shown in FIG. 8, longitudinal axis 802 of relief 416*a* is oriented with offset angle 814 relative to tangent line 806, offset angle 816 relative to tangent line 808, and offset angle 818 relative to a midline of a wearer's foot, relative to a midline of an average wearer's foot, or relative to a longitudinal axis of insole 402*a*, such as longitudinal axis 502 of insole pad 408*a* or the longitudinal axis of heel cap 410*a* (line 904 in FIG. 9). Offset angle 818 is preferably based on an angle of the orientation of a medio-lateral joint axis of a wearer's subtalar joint (for example, offset angle 818 may have a medial deviation value of less than or more than 0, 5, 10, 15, 20, 25, 30, 35, 40, or 45 degrees) or an average angle of the orientation of a medio-lateral joint axis of the average wearer's subtalar joint (for example, offset angle 818 may have a medial deviation value of 16°), which preferably reinforces natural joint decoupling around the medio-lateral axis line for the particular wearer or the average wearer during a heel contact phase of a gait cycle of the particular wearer or the average wearer. Preferably, the heel reliefs extend to the hole that receives the heel pads to facilitate magnifying the flexibility of the heel pads provided by the heel reliefs, which is especially beneficial for wearers who experience increased lateral load, such as bow-legged wearers. In versions that lack holes to receive heel pads, the heel reliefs may extend further inward from the perimeter of the heel caps to provide the same or similar benefits.

As shown in FIGS. 1, 2, 4, and 5, each of the reliefs has one or more offset angles that correspond to one or more of offset angles 616-620, 710-714, or 814-818. One or more of the offset angles are preferably in the range of 0, 15, 30, 45, 60, 75, 90, or more or fewer degrees. Preferably, the offset angles of one or more of the reliefs orient the longitudinal axes of the one or more reliefs perpendicular to the tangent of the perimeter of the heel cap where the perimeter intersects the longitudinal axes of the one or more reliefs. Varying the offset angles of one or more reliefs adjusts the directions that one or more corresponding tabs are predisposed to move upon encountering forces. Increasing the length or the width of a relief or a tab decreases the stiffness of an insole in the region associated with the relief or tab, and decreasing the length or the width of the relief or the tab increases the stiffness of the insole in the region associated with the relief or tab. The number or positions of reliefs or tabs can also be selected to provide increased or decreased stiffness in different regions of insoles 102*a*, 102*b* based on the desires or sensitivity of a wearer. For example, heel caps 110*a*, 110*b*, 410*a*, 410*b* preferably have one or more medial reliefs, such as medial reliefs 412*b*, 412*e*, with at least the medial end portions of the one or more reliefs disposed in arch support regions of heel caps 110*a*, 110*b*. In some versions, tangential lines at open ends of reliefs may be replaced for measurement purposes with straight lines that extend between opposing points at the open ends of the reliefs, such as the corners of relief 412*b* at the perimeter 608 of heel cap 410*a*. Each of the reliefs in heel caps 110*a*, 110*b*, 410*a*, 410*b* are mechanical reliefs.

Figure 9:
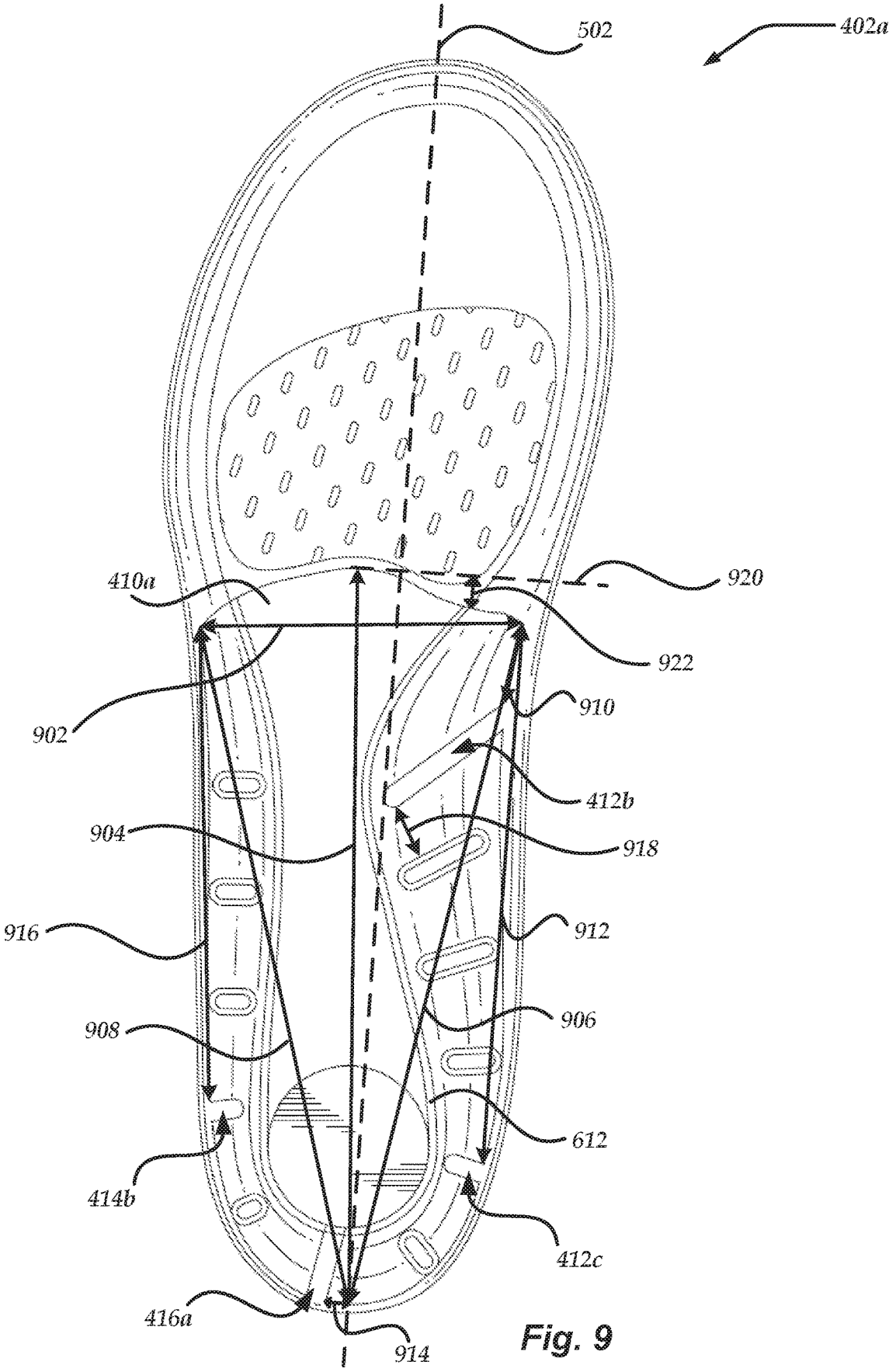
FIG. 9 is a bottom view of the insole of FIG. 5.

FIG. 9 is a bottom view of insole 402*a*. Heel cap 410*a* has maximum width 902 that extends from the front medial corner to the front lateral corner of heel cap 410*a*, maximum length 904, length 906 that extends from the front medial corner to the rearmost point of heel cap 410*a*, and length 908 that extends from the front lateral corner to the rearmost point of heel cap 410*a*. Positions of the reliefs may be described relative to dimensions or features of the heel caps or other elements of the insoles, such as width 902 or lengths 904-908. Distance 910 from the front medial corner of heel cap 410*a* to the front medial corner of medial relief 412*b* is preferably 35, 30, 25, 20, or less percent of width 904 or 20, 15, 10, 5, or less percent of one or more of lengths 904-908. Distance 912 from the front medial corner of heel cap 410*a* to the front medial corner of medial relief 412*c* is preferably 180, 175, 170, 165, 160, or less percent of width 904 or 90, 85, 80, 75, 70, or less percent of one or more of lengths 904-908. Distance 914 from the rearmost point of heel cap 410*a* to the closest rear corner (for example, the rear medial corner) of heel relief 416*a* is preferably 20, 15, 10, 5, or fewer percent of width 902 or one or more of lengths 904-908. Distance 916 from the front lateral corner of heel cap 410*a* to the front lateral corner of lateral relief 414*b* is preferably 160, 155, 150, 145, 140, or less percent of width 902 or 80, 75, 70, 65, 60, or less percent of one or more of lengths 904-908. Distance 918 between the closest two portions of two or more of the reliefs is preferably 30, 25, 20, 15, 10, or less percent of width 902 or 20, 15, 10, 5, or fewer percent of one or more of lengths 904-908.

The length of medial relief 412*b* is preferably 60, 55, 50, 45, 40 or less of width 902 or 35, 30, 25, 20, 15, or less percent of one or more of lengths 904-908. The length of medial relief 412*c* is preferably 25, 20, 15, 10, or less percent of width 902 or 20, 15, 10, 5, or less percent of one or more of lengths 904-908. The length of heel relief 416*a* is preferably 35, 30, 25, 20, or less percent of width 902 or 25, 20, 15, 10, or less percent of one or more of lengths 904-908. The length of lateral relief 414*b* is preferably 25, 20, 15, 10, or less percent of width 902 or 20, 15, 10, 5, or less percent of one or more of lengths 904-908. The width of one or more portions of one or more of the reliefs is preferably 20, 15, 10, 5, or less percent of width 902 or one or more of lengths 904-908.

In some versions, one or more of the reliefs of heel caps 110*a*, 110*b*, 410*a*, 410*b* are positioned according to one or more of those dimensions described regarding one or more of reliefs 412*b*, 412*c*, 414*b*, 416*a*. Preferably, one or more of the reliefs of heel caps 110*a*, 110*b*, 410*a*, 410*b* are sized, positioned (for example, one or more of location or orientation), and dimensioned according to one or more of those dimensions or angles described regarding one or more of reliefs 412*b*, 412*c*, 414*b*, 416*a*. FIGS. 1-9 are drawn to scale. The dimensions or angles shown relative to one or more other dimensions or features may be implemented with the same values as those shown or may be implemented with values that are greater or less than those shown.

Heel caps 110*a*, 110*b*, 410*a*, 410*b* preferably include one or more materials, such as carbon, fiber-reinforced plastics, closed-cell hardened ethylene-vinyl acetate ("EVA"), thermoplastic polyurethane ("TPU"), polypropylene, nylon reinforced with carbon fibers, or other materials. Insole pads 108*a*, 108*b*, 408*a*, 408*b* preferably include one or more materials, such as closed- or open-celled polyurethane ("PU") or an EVA base with a layer of PU on top of the EVA base. Heel pads 124*a*, 124*b*, 424*a*, 424*b* and forefoot pads 126*a*, 126*b*, 426*a*, 426*b* may include the same or different materials, and the material selection may be shoe-specific. For example, in performance shoes, heel pads 124*a*, 124*b*, 424*a*, 424*b* preferably include damping materials, and forefoot pads 126*a*, 126*b*, 426*a*, 426*b* preferably include spring/rebounding materials. The degree of damping or rebounding is preferably controlled at least in part based on ratios of EVAs or polyurethanes that are blended together. One or more portions of the insoles, such as the forefoot pads or the insole pads, are preferably perforated to reduce weight or increase flexibility or immediate compressibility. One or more other portions of the insoles, such as the heel pads or portions of the insole pads, are preferably non-perforated to increase durability of those portions. Preferably, one or more portions of the insoles are beveled. For example, the heel caps may have a thickness that decreases along the longitudinal axes of the heel caps from the rear to the front of the heel caps.

Preferably, the heel caps terminate rearward of the first metatarsal head of the wearer (see curvature of the medial-side portion of the toe-end perimeter of the heel caps). Absence of the heel cap material under the first metatarsal phalangeal joint (or only the insole pad material under the first metatarsal phalangeal joint) facilitates a decrease in a dorsiflexion moment experienced by the first metatarsal head during the wearer's gait cycle and facilitates easier plantar flexion of the first metatarsal head joint during a propulsive phase of the gait cycle. Accordingly, the insoles facilitate reducing stress on the foot. For example, FIG. 9 shows line 920 extending from the most forward portion of heel cap 410*a*, with line 920 being orthogonal to longitudinal axis 502 and being positioned distance 922 forward of a front edge of heel cap 410*a* on the medial side of longitudinal axis 502. Line 920 may alternatively be oriented orthogonal to length 904.

Distance 922 is preferably measured along the longitudinal axis of the first metatarsal (projected onto a horizontal surface) or along a path that extends parallel to one or more axes (for example, longitudinal axis 502, length 904) from line 920 to a portion of heel cap 410*a* (for example, an intersection of the front edge of heel cap 410*a* and the inner edge of ridge 612, an intersection of the front edge of heel cap 410*a* and the outer edge of ridge 612, or a most rearward portion of the front edge of the bottom surface of heel cap 410*a* on the medial side of length 904). Distance 922 is preferably 2.5, 5, 10, 15, 20, or more percent of width 902 or one or more of lengths 904-908. The width of the metatarsal head cutout is preferably measured along line 920, from the most lateral portion of the metatarsal head cutout (for example, the most forward portion of heel cap 410*a* or a center point of the front edge of the bottom surface of heel cap 410*a*) to the a portion of heel cap 410*a* (for example, an intersection of the front edge of heel cap 410*a* and the inner edge of ridge 612, an intersection of the front edge of heel cap 410*a* and the outer edge of ridge 612, the most rearward portion of the front edge of the bottom surface of heel cap 410*a* on the medial side of length 904, or the most medial portion of the front edge of the heel cap 410*a*). The width of the metatarsal cutout is preferably 5, 10, 15, 30, 35, 40, 45, 50, 55, 60, 65, or more of width 902 or one or more of lengths 904-908.

The number, positions, sizes, or shapes of one or more of the reliefs may be selected based on the rigidity or stiffness of the material in one or more of the heel caps or insole pads. If more rigid or stiff material is used, the reliefs are preferably larger to offset the increase in haptic feedback provided by the insoles to the wearer. For example, nylon (flexural modulus of elasticity of approximately 400,000) is typically stiffer than polypropylene (flexural modulus of elasticity of approximately 200,000) or EVA (flexural modulus of elasticity of approximately 2,500). The number, positions, sizes, or shapes of one or more of the reliefs may be adjusted based on the footwear that receives the insoles. For example, the reliefs may be smaller if the insoles are intended to be inserted in performance shoes and may be larger if the insoles are intended to be inserted in casual shoes.

The peripheral sidewalls of heel caps 110*a*, 110*b*, 410*a*, 410*b* maintain the shape of the upper surface (not shown) of insoles 102*a*, 102*b*, 402*a*, 402*b* in a cup shape to facilitate cupping the wearer's foot and provide increased surface area of insole pads 108*a*, 108*b*, 408*a*, 408*b* that is in contact with the wearer's foot to reduce stress on the wearer's foot. In contrast to relief cuts along the front edge of a heel cap to improve the flexibility of the heel cap in the vertical/longitudinal dimensions for easier walking motions by the wearer, the reliefs along the peripheral sidewalls of heel caps 110*a*, 110*b*, 410*a*, 410*b* mitigate haptic feedback provided to the peripheral portions of the wearer's feet by the peripheral sidewalls of insoles 102*a*, 102*b*, 402*a*, 402*b* while influencing support provided to the wearer by insoles 102*a*, 102*b*, 402*a*, 402*b*. Heel caps 110*a*, 110*b*, 410*a*, 410*b* maintain the shape of the upper surface (not shown) of insoles 102*a*, 102*b*, 402*a*, 402*b* while allowing insoles 102*a*, 102*b*, 402*a*, 402*b* to be deconstructively accommodating. Accordingly, insoles 102*a*, 102*b*, 402*a*, 402*b* increase natural movement of the wearer's feet while providing and holding a non-compressed shape of the wearer's feet through the gate cycle.

Insoles may alter lower extremity kinetic, kinematics, and electromyography (EMG) muscle activity, and each individual may respond to a given insole differently. Differences in what people perceive as comfortable regarding insoles may be related to differences in shapes or materials of the insoles and may be linked to anthropometric, neuromechanical, and sensory factors for each person. If an insole is comfortable to a wearer, the insole likely enhances or supports the wearer's preferred movement pathway (for example, how the configuration of the wearer's bones, muscles, ligaments, and tendons tends to cause the body to naturally move). Supporting the body's preferred movement pathway may lead to a reduction in vibration and a reduction in EMG muscle activity to execute a given movement task (for example, running). Accordingly, comfort is important when considering insoles at least because evaluations of insoles using comfort reflect subjective perception and also differences in functional biomechanical variables. The concepts described herein facilitate generating insoles that provide increased levels of comfort and support to the wearer.

The foregoing examples should not be construed as limiting or exhaustive, yet rather, illustrative use cases to show implementations of at least one of the various embodiments of the invention. Accordingly, many changes can be made without departing from the spirit and scope of the invention. For example, each feature of one or more of insoles 102*a*, 102*b*, 402*a*, 402*b* may be replaced with or combined with one or more corresponding features of one or more other ones of 102*a*, 102*b*, 402*a*, 402*b*, or one or more portions or features of one or more of insoles 102*a*, 102*b*, 402*a*, 402*b* may be omitted. As another example, each value discussed above preferably defines a range with that value at one end of the range and any other value discussed above at the other end of the range. In some versions, the values of the offset angles may be measured when the corresponding axes are projected onto a horizontal plane. Thus, the scope of the invention is not limited by the disclosure of the examples. Instead, the invention should be determined entirely by reference to the claims that follow.

The embodiments of the invention in which an exclusive property or privilege is claimed are defined as follows:

1. An insole for footwear, the insole comprising:
a bottom surface having a perimeter;
a peripheral sidewall that extends upward from the perimeter of the bottom surface; and
a relief in the peripheral sidewall,
wherein the bottom surface has a hole that is positioned, sized, and dimensioned to receive a heel pad, and the relief extends to the hole.

2. An insole for footwear, the insole comprising:
a bottom surface having a perimeter;
a peripheral sidewall that extends upward from the perimeter of the bottom surface; and
a relief in the peripheral sidewall,
wherein the insole has a toe-end portion, a heel-end portion, and an arch-support portion, the insole has a longitudinal axis that extends from the toe-end portion to the heel-end portion, and the relief has a longitudinal axis that is oriented with an offset angle of 0-45° from the longitudinal axis of the insole in the arch-support portion and angled inward toward the heel-end portion.

3. The insole of claim 1, wherein the peripheral sidewall has an outer perimeter, the relief has a longitudinal axis that extends toward a point in the outer perimeter of the peripheral sidewall, the peripheral sidewall has a tangent at the point in the outer perimeter of the peripheral sidewall, and the longitudinal axis of the relief is oriented with an offset angle of 80-90° from the tangent at the point in the outer perimeter of the peripheral sidewall.

4. An insole for footwear, the insole comprising:
a bottom surface having a perimeter;
a peripheral sidewall that extends upward from the perimeter of the bottom surface; and
a relief in the peripheral sidewall,
wherein the peripheral sidewall has an outer perimeter, the insole has a heel-support portion, and the relief is disposed in the heel-support portion and extends to the outer perimeter of the peripheral sidewall.

5. The insole of claim 1, wherein the relief extends from the peripheral sidewall into the bottom surface.

6. The insole of claim 1, further comprising a second relief, the bottom surface having a hole that is positioned, sized, and dimensioned to receive a heel pad, and the relief and the second relief being disposed on opposite sides of the hole from each other.

7. The insole of claim 1, wherein the bottom surface has a toe-end portion and a heel-end portion disposed rearward of the toe-end portion, and at least a portion of the relief is disposed rearward of the heel-end portion of the bottom surface.

8. The insole of claim 1, wherein at least one portion of the peripheral sidewall provides an arch support, and another relief is disposed in the at least one portion of the peripheral sidewall that provides the arch support.

9. The insole of claim 4, further comprising a second relief in the heel-support portion of the peripheral sidewall and extending to the outer perimeter of the peripheral sidewall, the relief and the second relief defining a tab disposed between the relief and the second relief, and at least a portion of the tab being movable relative to the bottom surface.

10. The insole of claim 1, wherein the bottom surface includes a bottom surface of a heel cap, and the peripheral sidewall includes a peripheral sidewall of the heel cap.

11. The insole of claim 1, further comprising an insole pad, the bottom surface including a bottom surface of a heel cap, the peripheral sidewall including a peripheral sidewall of the heel cap, and the insole pad having a recess that is positioned, sized, and dimensioned to receive at least a portion of the heel cap.

12. The insole of claim 1, further comprising an insole pad, the bottom surface including a bottom surface of a heel cap, the peripheral sidewall including a peripheral sidewall of the heel cap, and the insole pad having a plug that at least partially fills the relief.

13. The insole of claim 1, further comprising a relief that has a radiused end portion.

14. The insole of claim 1, wherein the relief includes a relief cut.

15. The insole of claim 1, further comprising:

an insole pad; and a heel cap coupled to the insole pad, the heel cap being more rigid than the insole pad, the heel cap including the bottom surface, the peripheral sidewall, and the relief.

16. The insole of claim 1, further comprising:

a heel cap that includes the bottom surface, the peripheral sidewall, and the relief; and an insole pad coupled to the heel cap, the insole pad being less rigid than the heel cap, the insole cap having a relief plug that is positioned, sized, and dimensioned to be received in the relief in the heel cap.

17. A set of insoles for footwear, comprising:

a first insole of a first size, the first insole including:

a first bottom surface having a perimeter;

a first peripheral sidewall that extends upward from the perimeter of the first bottom surface; and a first relief in a first position in the first peripheral sidewall; and a second insole of the first size, the second insole including:

a second bottom surface having a perimeter;

a second peripheral sidewall that extends upward from the perimeter of the second bottom surface, the second peripheral sidewall being less stiff than the first peripheral sidewall; and a second relief in a second position in the second peripheral sidewall, the second position corresponding to the first position, and the second relief being smaller than the first relief.

18. The set of insoles of claim 17, wherein the first peripheral sidewall includes a first material, and the second peripheral wall includes a second material that is less stiff than the first material.

19. The set of insoles of claim 17, wherein the first bottom surface has a toe-end portion and a heel-end portion disposed rearward of the toe-end portion of the first bottom surface, at least a portion of the first relief is disposed rearward of the heel-end portion of the first bottom surface, the second bottom surface has a toe-end portion and a heel-end portion disposed rearward of the toe-end portion of the second bottom surface, and at least a portion of the second relief is disposed rearward of the heel-end portion of the second bottom surface.

20. The set of insoles of claim 17, wherein at least one portion of the first peripheral sidewall provides a first arch support, the first relief is disposed in the at least one portion of the first peripheral sidewall that provides the first arch support, at least one portion of the second peripheral sidewall provides a second arch support, and the second relief is disposed in the at least one portion of the second peripheral sidewall that provides the second arch support.

21. The set of insoles of claim 17, wherein the first relief includes a first relief cut, and the second relief includes a second relief cut.

* * * * *